US009192226B2

(12) United States Patent
Hiramoto

(10) Patent No.: US 9,192,226 B2
(45) Date of Patent: Nov. 24, 2015

(54) METHOD FOR MANUFACTURING BRISTLE HEAD FOR BRUSH

(71) Applicant: NIHON SANMO DYEING CO., LTD., Kyoto-shi, Kyoto (JP)

(72) Inventor: Takeshi Hiramoto, Kyoto (JP)

(73) Assignee: NIHON SANMO DYEING CO., LTD., Kyoto (JP)

( * ) Notice: Subject to any disclaimer, the term of this patent is extended or adjusted under 35 U.S.C. 154(b) by 333 days.

(21) Appl. No.: 13/813,246

(22) PCT Filed: Oct. 1, 2012

(86) PCT No.: PCT/JP2012/075376
§ 371 (c)(1),
(2) Date: Jan. 30, 2013

(87) PCT Pub. No.: WO2014/002300
PCT Pub. Date: Jan. 3, 2014

(65) Prior Publication Data

US 2015/0115692 A1 Apr. 30, 2015

(30) Foreign Application Priority Data

Jun. 27, 2012 (JP) ..... 2012-143811

(51) Int. Cl.
*A46D 1/00* (2006.01)
*A46D 1/04* (2006.01)
(Continued)

(52) U.S. Cl.
CPC .. *A46D 1/04* (2013.01); *A46D 1/08* (2013.01); *A46D 9/06* (2013.01); *A46D 1/02* (2013.01); *A46D 1/0207* (2013.01); *A46D 1/0276* (2013.01)

(58) Field of Classification Search
CPC ..... A46D 1/006; A46D 1/02; A46D 1/0207; A46D 1/0276; A46D 1/04; A46D 1/045; A46D 1/05
USPC ..... 300/21; 15/207.2
See application file for complete search history.

(56) References Cited

U.S. PATENT DOCUMENTS 8,952,939 B2 * 2/2015 Lee ..... 345/179
2003/0182750 A1 * 10/2003 Nishida et al. ..... 15/193
(Continued)

FOREIGN PATENT DOCUMENTS

CN 1118818 A 3/1996
CN 101002644 A 7/2007
(Continued)

OTHER PUBLICATIONS

International Search Report PCT/JP7012/075376 DTED Dec. 25, 2012.
(Continued)

*Primary Examiner* — Laura C Guidotti
(74) *Attorney, Agent, or Firm* — Foley & Lardner LLP

(57) ABSTRACT

A method for manufacturing a bristle head for a brush is provided. The method includes a first step of obtaining a fiber bundle by reeling up a melt-spun synthetic fiber, a second step of obtaining a unit fiber bundle by cutting the fiber bundle in a direction perpendicular to a longitudinal direction, a third step of forming a tapered shape at a tip portion of each fiber included in the unit fiber bundle, a fourth step of forming a bristle head by isolating a part of the unit fiber bundle, and a fifth step of forming a conductive portion including a conductive material on a surface of each by immersing the bristle head in a treatment bath accommodating a treatment liquid.

5 Claims, 3 Drawing Sheets

(51) Int. Cl.

| | |
|---|---|
| ***A46D 1/08*** | (2006.01) |
| ***A46D 9/06*** | (2006.01) |

(56) References Cited

U.S. PATENT DOCUMENTS

| | | | | |
|---|---|---|---|---|
| 2004/0140582 | A1* | 7/2004 | Frankfort et al. | 264/103 |
| 2012/0116147 | A1* | 5/2012 | Lim et al. | 600/9 |
| 2013/0139340 | A1* | 6/2013 | Hiramoto et al. | 15/207.2 |

FOREIGN PATENT DOCUMENTS

| | | | | |
|---|---|---|---|---|
| JP | 61-097469 A | | 5/1986 | |
| JP | 6-44428 | * | 6/1994 | A46B 9/08 |
| JP | 2008-109990 A | | 5/2008 | |
| JP | 2012-040302 | | 3/2012 | |

OTHER PUBLICATIONS

Chinese Office Action dated Jan. 28, 2015 issued in Application No. 201280002273.9.

* cited by examiner

METHOD FOR MANUFACTURING BRISTLE HEAD FOR BRUSH

TECHNICAL FIELD

The present invention relates to a method for manufacturing a bristle head for a brush. More particularly, it relates to a method for manufacturing a bristle head for a brush, composed of fibers each having a conductive portion on a surface thereof.

BACKGROUND ART

In recent years, improved synthetic fibers achieving features close to animal hair have been used as alternatives to animal hair. For example, Japanese Patent Laying-Open No. 2008-109990 (PTL 1) discloses a method for manufacturing a filament having a surface structurally similar to cuticles of animal hair. According to the disclosed method, the filament is manufactured by mixing and melt-spinning inorganic powder and polyethylene terephthalate to prepare a filament and stretching the same. Further, PTL 1 discloses that one end of the stretched filament is immersed in an alkaline solution to obtain a tapered shape.

CITATION LIST

Patent Literature

PTL 1: Japanese Patent Laying-Open No. 2008-109990

SUMMARY OF INVENTION

Technical Problem

A brush including conductive fibers prepared by providing a conductivity to synthetic fibers described above exhibits a neutralization effect. Therefore, the brush is extremely useful as a cosmetic brush. Particularly in recent years, the brush also attracts attention for its capability to achieve fine drawings on a screen of electronic equipment such as a smartphone provided with a touch panel, and a demand is increasing rapidly.

At present, a bristle head for such brush described above including the conductive fibers is manufactured as follows. Firstly, a fiber bundle composed of synthetic fibers is formed. After the tip of each fiber of the fiber bundle is processed to have a tapered shape, the fiber bundle is immersed in a treatment liquid containing a conductive material dissolved therein, so that a fiber bundle composed of fibers each having a tapered shape on the tip thereof and a surface provided with a conductive portion is obtained. Further, fibers isolated from the fiber bundle are gathered.

According to the manufacturing method described above, the tapered tips are disarranged very easily when the fiber bundle is immersed in the treatment liquid having a conductive material dissolved therein in the step of forming a conductive portion (in the following, also referred to as "conductive treatment"). Therefore, controlling the shape of the fiber was extremely difficult. Further, since there was great variability in the finished states, the bristle head for a brush has been manufactured by selecting fibers with a desired quality suitable for each application from the fiber bundle, and bundling the selected fibers. Since the selecting operation involves delicate operation, screening by means of an automatic machine has been extremely difficult to achieve. Therefore, a manual operation has been the only way to achieve the selecting operation. Further, at the same time, the amount of waste fiber discarded in the selecting operation has reached in some cases approximately 80% of the fiber bundle applied with the conductive treatment. Therefore, there was a major problem in the usability of raw material.

At present, there has not been known an efficient method for manufacturing a bristle head for a brush including conductive fibers as an alternative to the manufacturing method described above. Therefore, there has been an anticipation that the continuously expanding demand cannot be met in the future.

The present invention was achieved in light of such present circumstances, and its object is to provide a method for manufacturing a bristle head for a brush composed of synthetic fibers, the method including the steps of processing a tip of a fiber to have a tapered shape, and performing a fiber surface treatment, such as a conductive treatment, a dyeing treatment, and a bleaching treatment, of immersing the fiber in various treatment liquids to improve the yield considerably, simplify manufacturing steps, and reduce significantly the amount of waste raw material.

Solution To Problem

The manufacturing method according to the present invention is characterized in manufacturing a fiber bundle composed of fibers processed to have a tapered shape, isolating the fiber bundle, forming a bristle head having a shape to be used eventually as a brush, and performing a liquid treatment such as a conductive treatment to the bristle head.

Specifically, the manufacturing method according to the present invention is characterized in including a first step of obtaining a fiber bundle by reeling up a melt-spun synthetic fiber, a second step of obtaining a unit fiber bundle by cutting the fiber bundle in a direction perpendicular to a longitudinal direction, a third step of forming a tapered shape at a tip portion of each fiber included in the unit fiber bundle, a fourth step of forming a bristle head by isolating a part of the unit fiber bundle, and a fifth step of forming a conductive portion including a conductive material on a surface of each fiber by immersing the bristle head in a treatment bath accommodating a treatment liquid.

Preferably, the fiber has a fiber diameter greater than or equal to 0.05 mm and less than or equal to 1.00 mm.

Preferably, the bristle head has a diameter greater than or equal to 1.0 mm and less than or equal to 30.0 mm.

Preferably, the synthetic fiber is of one type selected from the group consisting of a polyester synthetic fiber, an acrylic synthetic fiber, and a polyamide synthetic fiber. More preferably, the synthetic fiber includes polybutylene terephthalate.

Preferably, the treatment liquid is an aqueous solution containing at least one type of metal ion selected from the group consisting of $Cu^{2+}$, $Ag^{+}$, and $Pd^{2+}$, and a reductant agent, or is a plating solution containing at least one type of metal selected from the group consisting of Cu, Ag, and Ni.

Preferably, the reductant agent is made of $Na_2S_2O_3$ or $NaHSO_3$. Further, preferably, the conductive material includes a sulfide of at least one type of metal selected from the group consisting of Cu, Ag, and Pd, or plating metal of at least one type of metal selected from the group consisting of Cu, Ag, and Ni. More preferably, the conductive material includes copper sulfide.

Preferably, a surface electric resistance value of the fiber including the conductive portion on the surface thereof is greater than or equal to $10^{-1}$ Ω/cm and less than or equal to $10^{9}$ Ω/cm.

Advantageous Effects Of Invention

According to the manufacturing method of the present invention, the steps of manufacturing a bristle head for a brush including the step of performing a fiber surface treatment of immersing in a treatment liquid a synthetic fiber having a tapered shape on a tip portion thereof dramatically improves the yield and considerably reduces the amount of waste raw material, and the entire manufacturing steps can be simplified.

DESCRIPTION OF EMBODIMENTS

Figure 1:
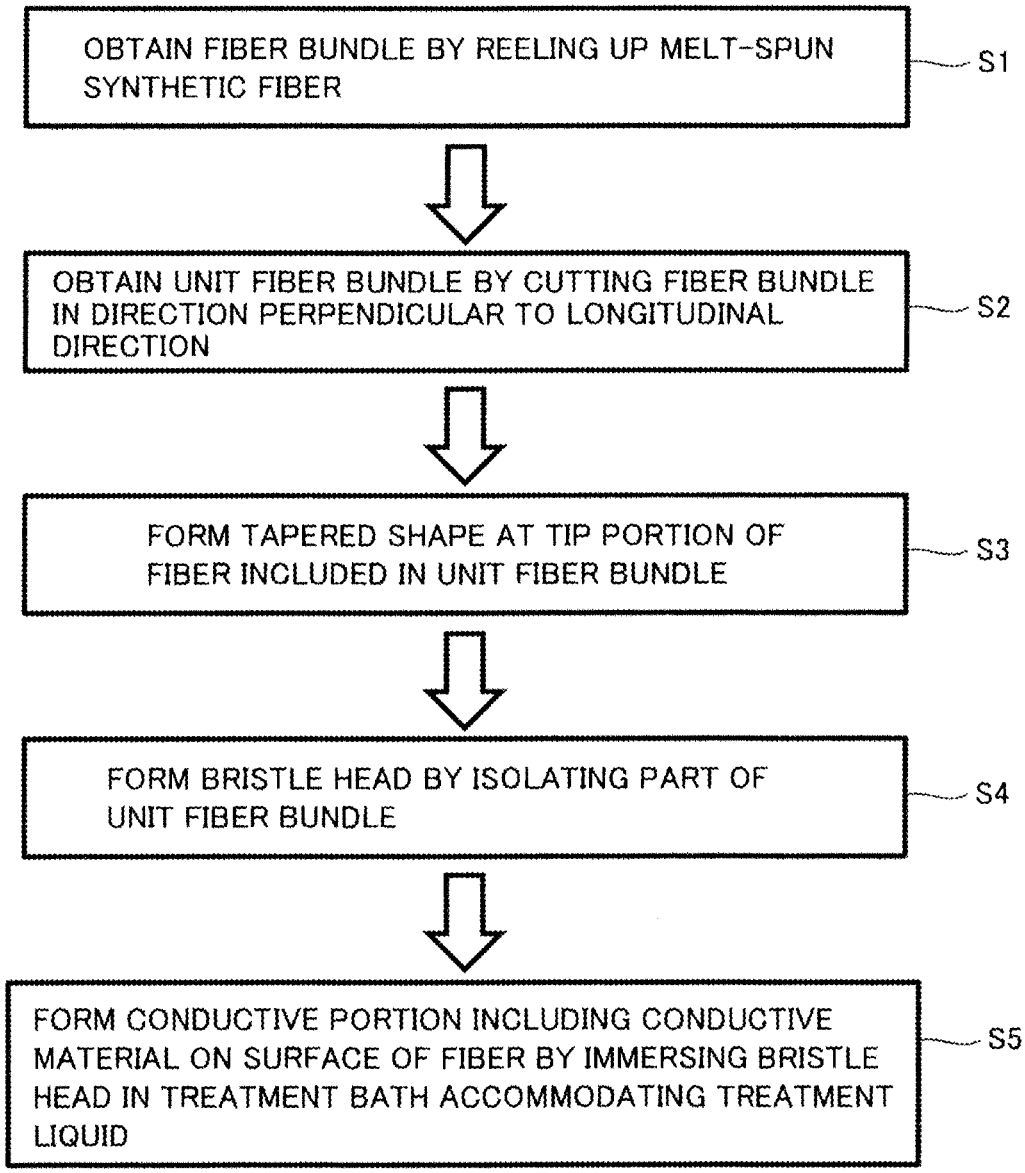
FIG. 1 represents the contents of each step according to the manufacturing method of the present invention.

Hereinafter, a method for manufacturing a bristle head for a brush according to the present invention will be described more in detail. The method for manufacturing a bristle head for a brush according to the present invention is characterized in including the following first through fifth steps, as shown in FIG. 1. The manufacturing method according to the present invention may include an additional step as long as the following first through fifth steps are included. The effect of the present invention is exhibited as long as the first through fifth steps are included. In the following, each step will be described in detail.

<First Step>

In the first step of the manufacturing method according to the present invention, a melt-spun synthetic fiber is reeled up to obtain a fiber bundle.

<<Melt-Spinning Device>>

Any conventionally known melt-spinning device may be employed. Preferably, the melt-spinning device is provided with an extruding nozzle suitable for a brush fiber.

<<Synthetic Fiber>>

The synthetic fiber of one type selected from the group consisting of a polyester synthetic fiber, an acrylic synthetic fiber, and a polyamide synthetic fiber may be employed. Specifically, as a polyester synthetic fiber, it is preferable to employ polybutylene terephthalate and polyethylene terephthalate. As an acrylic synthetic fiber, it is preferable to employ acrylonitrile and a modacrylic fiber manufactured by Kaneka Corporation. Further, as a polyamide synthetic fiber, it is preferable to employ nylon 6, nylon 66, and nylon 612. In the case of immersing a fiber in an alkaline solution to form a tapered shape at the tip portion of the fiber, it is preferable to use polybutylene terephthalate capable of being melted promptly and formed readily to have a tapered shape with a certain gradient.

<<Fiber>>

Preferably, a fiber diameter of the fiber is greater than or equal to 0.05 mm and less than or equal to 1.00 mm. More preferably, the fiber diameter is greater than or equal to 0.06 mm and less than or equal to 0.30 mm. The fiber diameter of less than 0.05 mm causes lack of hardness suitable for a brush and lowers easiness in handling. The fiber diameter exceeding 1.00 mm is not preferable since it affects texture of the resulting brush.

<<Fiber Bundle>>

The melt-spun synthetic fiber is cooled to be solidified, stretched, and thereafter continuously reeled up on a rotational shaft to form a fiber bundle. The diameter of the fiber bundle is not particularly limited. The diameter can be suitably adjusted in light of limitation on the manufacturing facility. The fiber bundle may be accommodated in a cylindrical body or the like for ease in subsequent processing.

<<Second Step>>

In the second step of the manufacturing method according to the present invention, the fiber bundle obtained in the first step is cut in a direction perpendicular to a longitudinal direction to obtain a unit fiber bundle.

<<Unit Fiber Bundle>>

Figure 2:
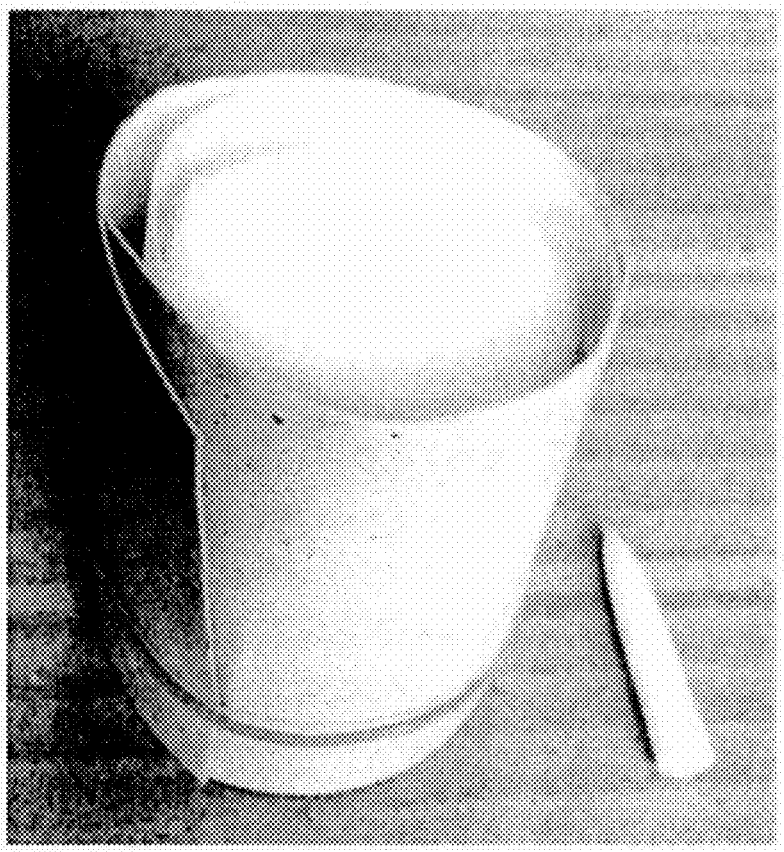
FIG. 2 represents an example of a unit fiber bundle and a bristle head according to the manufacturing method of the present invention.

The length of the unit fiber bundle is not particularly limited. The length may be suitably set in conformity with the type and the like of a subject brush. One end of the cut fiber bundle is fixed so that the unit fiber bundle can be obtained. The method for fixing the one end of the cut fiber bundle is not particularly limited. For example, a fixing method of binding with use of a rubber band or a string, a fixing method of using an adhesive tape such as a paper tape, and the like may be employed. For example, the unit fiber bundle may be entirely fixed by winding a plastic sheet around the unit fiber bundle and fixing the fiber bundle over the sheet by any of the methods described above. An example of the fiber bundle having a circumference fixed using hardened paper is shown in the center of FIG. 2.

<<Third Step>>

In the third step of the manufacturing method according to the present invention, a tip portion of the fiber included in the unit fiber bundle obtained in the second step is processed to form a tapered shape.

For example, a method for forming a tapered shape by processing a tip portion of the fiber may include a method of forming a tapered shape by immersing the fiber in an alkaline solution to cause an outer surface of the fiber to be dissolved, a method of forming a tapered shape by machining such as grinding and polishing, or the like. Preferably, the method of immersing in an alkaline solution is employed to obtain a thin and sharp tip portion.

<<Method of Forming a Tapered Shape by Immersing in an Alkaline Solution>>

In the case of immersing the fiber in an alkaline solution to obtain a tapered shape at the tip portion, the alkaline solution may be an alkaline aqueous solution, an organic solvent, and the like. In the case of using an alkaline solution, the tip portion on a side opposite to the fixed portion of the unit fiber bundle is immersed in 30 mass % of a sodium hydroxide solution with the liquid temperature of approximately 60° C. for 6-12 hours. Further, heated dimethylformamide (DMF) and a heated phenolic solvent may be used preferably as an organic solvent in the case of a polyester synthetic fiber. Acetone and DMF can be used preferably in the case of an acrylic synthetic fiber. A phenolic solvent can be used preferably in the case of a polyamide synthetic fiber.

In this stage, a capillary action causes the alkaline solution to rise from the immersed one end of the fiber to the other end along the surface of the fiber. This causes the surface of the fiber along which the alkaline solution runs to be dissolved by the alkaline solution. At this stage, a greater amount of alkaline solution runs as a function of shorter distance from the tip of the immersed one end. Therefore, each fiber is dissolved so that the diameter of the cross section becomes smaller (in other words, thinner) at the tip of the immersed one end and becomes larger (in other words, more thicker) toward the other end. Consequently, a tapered shape can be formed on each fiber.

Further, at this stage, the tapered tip portion can be formed sharper as the immersing time becomes longer. Further, as the liquid temperature of the alkaline solution is higher, or as the concentration of the alkaline solution is higher, the fiber can be dissolved more promptly.

<<Washing>>

After being immersed in the alkaline solution, the fiber may be washed. For example, the unit fiber bundle can be washed by being immersed in a washing liquid. Alternatively, the washing liquid may be poured on the unit fiber bundle. The washing liquid may be an acid aqueous solution containing water, citric acid, acetic acid, formic acid, sulfuric acid, and the like. After the washing, it is preferable to dry the fiber.

Since the alkaline solution adhered to the surface of the fiber can be removed by washing, dissolution of the fiber can be stopped promptly. Further, the degree of dissolution can be controlled by adjusting the concentration, temperature, and immersing time as to the alkaline solution. The degree of dissolution can be controlled also by washing after leaving the unit fiber bundle raised from the alkaline solution for a predetermined time period.

<<Method of Forming a Tapered Shape by Machining>>

Any conventionally known methods may be employed as a method of forming a tapered shape by machining. For example, a method of grinding by means of a wire brush, a method using abrasive grains, and the like may be employed.

The diameter of the cross section at the tapered tip portion is preferably greater than or equal to 3 μm and less than or equal to 10 μm in light of the texture and fineness. More preferably, the cross section is not present. In other words, the cross section preferably has a shape with a sharpened tip portion.

<<Fourth Step>>

In the fourth step of the manufacturing method according to the present invention, a part of the unit fiber bundle obtained in the third step with the fibers having a tapered shape is isolated to form a bristle head.

The method for isolating the bristle head from the unit fiber bundle is not particularly limited, and an arbitrary method may be employed. For example, the method may be employed including the steps of inserting a cylindrical body having a diameter corresponding to the diameter of a subject bristle head into the unit fiber bundle in a direction parallel to the longitudinal direction of the fibers, and isolating the part of the fibers accommodated in the cylindrical body as the bristle head.

<<Method for Fixing the Shape of the Bristle Head>>

The shape of the isolated bristle head is fixed. A method for fixing the shape of the bristle head is not particularly limited. For example, the method may be employed including the steps of inserting the isolated bristle head into a shaping pass having the shape of a bristle head, cutting the bristle head to have a specified length, and fixing the base by means of heat adhesion, water-soluble adhesive, or the like. The outer surface of the bristle head may be fixed entirely with the water-soluble adhesive.

Preferably, the diameter of the isolated bristle head is greater than or equal to 1.0 mm and less than or equal to 30.0 mm. More preferably, the diameter is greater than or equal to 3.0 mm and less than or equal to 20.0 mm. When the diameter of the bristle head is greater than or equal to 1.0 mm and less than or equal to 30.0 mm, the treatment liquid can readily permeate into the surface of each fiber in the fifth step described below. Therefore, a conductive portion can be formed on the surface of each fiber without deforming the fiber. Further, the diameter of the bristle head can be set arbitrarily within the above-described range in conformity with the application and specification of the brush. An example of the bristle head having an entirely fixed outer surface is shown in the lower right part of FIG. 2.

<<Fifth Step>>

In the fifth step of the manufacturing method, the bristle head obtained in the fourth step is immersed in the treatment liquid to form a conductive portion made of a conductive material on the surface of each fiber included in the bristle head.

Preferably, the bristle head is immersed in the treatment liquid while being accommodated in a bag-like item. This can prevent disassembling of the bristle head by release of fixation and deformation of fibers due to contact of the bristle head with the wall face of the treatment bath. Further, the treated bristle head can be collected efficiently.

The bag-like item described above is not particularly limited. For example, the method may include the steps of accommodating a plurality of bristle heads in a bag made of porous material capable of allowing the treatment liquid to pass through freely, and immersing the bag in the treatment liquid.

Material for such bag for accommodating the bristle head may be of any material as long as it does not get entangled with the fibers of the bristle head and/or causes no damage to the fibers of the bristle head. In the case of the porous material, it is preferable to employ material which does not get entangled with the fibers. Such material may include, for example, a nylon fiber, a plant fiber, a non-woven fabric, and the like. Among these materials, a non-woven fabric made of polypropylene, polyethylene, or polyethylene terephthalate may be preferably employed. Preferably, the unit weight of a mesh for the bag-like material is selected in accordance with a fiber diameter.

The bag may have any size. The size is preferably adjusted so as not to damage the bristle head.

The treatment bath may have stirring means, circulating means, and the like for generating a water flow to improve the treatment efficiency. Conditions for stirring and circulating are preferably set so as not to cause disassembling and deformation of the bristle head fixed once. For example, in the case of using a closed Obermaier dyeing machine, the water stream is preferably adjusted so that the bag containing the bristle head and the bristle head itself are not disturbed by the impact.

<<Treatment Liquid>>

The treatment liquid in the present step may be an aqueous solution containing copper salt and thiosulfate. The bristle head is immersed in the treatment bath accommodating the aqueous solution, so that the conductive portion made of the conductive material can be formed on the surface of the fiber included in the bristle head.

It is preferable that the concentration of copper salt contained in the treatment liquid is greater than or equal to 5 mass % and less than or equal to 15 mass % with respect to the total mass of the bristle head treated at one time. It is preferable that the concentration of the thiosulfate is greater than or equal to 5 mass % and less than or equal to 15 mass % with respect to the total mass of the bristle head treated at one time. The temperature and immersing time as to the treatment liquid are not particularly limited and can be modified suitably.

Further, for example, the treatment liquid may be an aqueous solution containing copper sulfate and a reductant agent. The concentration of the copper sulfate in the treatment liquid is preferably greater than or equal to 10 mass % and less than or equal to 13 mass %, and the concentration of the reductant agent in the treatment liquid is preferably greater than or equal to 10 mass % and less than or equal to 13 mass %, with respect to the total mass of the bristle head treated at one time. The temperature and immersing time as to the treatment liquid are not particularly limited and can be modified suitably. Further, the reductant agent may be sodium thiosulfate ($Na_2S_2O_3$), sodium hydrogen sulfite ($NaHSO_3$), and the like.

By conducting the present step, a conductive portion covered with copper sulfide can be formed on the surface of the fiber included in the bristle head immersed in the treatment liquid. The conductive material is not limited to copper sulfate. For example, a sulfide of Ag (silver sulfide) and a sulfide of Pd (palladium sulfide) may be used, and also plating metal including at least one type of metal selected from the group consisting of Cu, Ag, and Ni can be used. In the case of forming the covered portion using the plating metal, a known plating method can be employed. In light of a low peeling and a low response with oxygen after formation, it is preferable to use copper sulfide.

The surface electric resistance value of the fiber having the conductive portion included in the brush bristle fiber obtained by the manufacturing method according to the present invention is preferably greater than or equal to $10^{-1}$ Ω/cm and less than or equal to $10^{9}$ Ω/cm. When the surface electric resistance value is within the range described above, the self-discharging feature of the fiber having the conductive portion tends to be high. Therefore, it is preferable to adjust the density and thickness of the covering portion so that the surface electric resistance value of the fiber having the conductive portion falls within the range described above. Further, the surface electric resistance value is preferably greater than or equal to $10^{1}$ Ω/cm and less than or equal to $10^{8}$ Ω/cm, and more preferably greater than or equal to $10^{2}$ Ω/cm and less than or equal to $10^{6}$ Ω/cm.

In any of the cases described above, an additional adjuvant such as a pH adjuster may be added to the treatment liquid. The pH adjuster may be, for example, an organic acid such as an acetic acid and a citric acid. Further, to retain the reducing condition in the treatment liquid, a weak reductant agent such as bisulfite soda, sulfite soda, and hypophosphorus acid soda can be used. Further, the additional adjuvant may be added to a bath other than the treatment bath accommodating the treatment liquid to immerse the bristle head in each bath sequentially.

By conducting the first through fifth steps described above, a bristle head for a brush having a tapered shape at a tip and made of synthetic fiber with a conductive portion formed on a surface thereof can be manufactured readily with an extremely high yield.

EXAMPLE

In the following, the manufacturing method according to the present invention will be described more in detail with reference to an example. However, the present invention is not limited to the example.

As the raw material for the synthetic fiber, a resin pellet made of polybutylene terephthalate was prepared. The resin pellet was supplied to a melt-spinning device, and then melted and kneaded in the device. Thereafter, the melt of polybutylene terephthalate was extruded from a nozzle tip.

Next, the melt of polybutylene terephthalate resin extruded from the nozzle tip was cool-solidified and stretched to obtain a polybutylene terephthalate fiber having a fiber diameter of 0.15 mm.

The polybutylene terephthalate fiber was manufactured continuously in the manner described above, and the fiber was reeled up on a four-sided frame attached to a rotational shaft of a reeling device, so that a fiber bundle was formed. The diameter of the fiber bundle was 45.0 mm.

The fiber bundle was cut at one part on the four-sided frame, folded into two, and then inserted into a cylindrical body made of polyethylene resin. Further, the fiber bundle was cut in a direction perpendicular to the longitudinal direction of the fiber at intervals of 60 mm in length (in other words, cut into round slices) to obtain a plurality of unit fiber bundles. Then, the cylindrical body was peeled off from each unit fiber bundle, and one end was fixed by binding with use of a rubber band.

The tip portion on the end opposite to the fixed end of the unit fiber bundle obtained in the manner described above was immersed in 30 mass % of a sodium hydroxide aqueous solution with the adjusted liquid temperature of 60° C. for 6 hours. Then, the fiber raised from the sodium hydroxide aqueous solution was immersed and washed in a water bath, and dried with hot air of 60-100° C. Accordingly, a tapered shape was formed at the tip portion of each fiber included in the fiber bundle.

Next, a cylindrical body made of polypropylene resin with a diameter of 6.0 mm was inserted to the unit fiber bundle having a tapered shape at the tip of each fiber from the fixed end side to accommodate the fibers such that no gap is formed in the cylindrical body. The cylindrical body was drawn out from the unit fiber bundle, and the fiber bundle accommodated therein was cut into a specified length. Next, the fiber bundle cut into the specified length was inserted into a bristle head shaping pass having therein a cavity formed to have the shape of the bristle head. Further, the end opposite to the tip of the bristle head was cut to adjust the length of the bristle head. Next, the cross section (in other words, the base of the bristle head) was treated with heat at the temperature of 250° C. to 300° C. for 10-15 seconds to fix the base. Thereafter, the contour of the bristle head was entirely fixed by a water-soluble adhesive. In the manner described above, a bristle head for a brush was obtained having a tapered shape at the tip of each fiber.

Next, ten of the above-described bristle heads were accommodated in a bag (width: 10 cm; depth: 10 cm) made of polypropylene spunbond (unit weight: 30 g/m$^2$).

Next, the bag was immersed in a treatment bath accommodating an aqueous solution containing copper sulfate and sodium thiosulfate as a reductant agent to form a conductive covering portion on the surface of the fiber. The concentration of the copper sulfate in the aqueous solution was 12 mass % with respect to the total mass of the bristle head, and the concentration of the reductant agent in the aqueous solution was 13 mass % with respect to the total mass of the bristle head. Then, the bag was raised from the treatment bath and applied with centrifugal dewatering. Thereafter, the bristle head was taken out from the bag and dried with hot air of 80° C. Consequently, a bristle head for a brush was obtained having a tapered shape at a tip of each fiber and having a covering portion (in other words, a conductive portion) made of a conductive material on the surface of each fiber.

Figure 3:
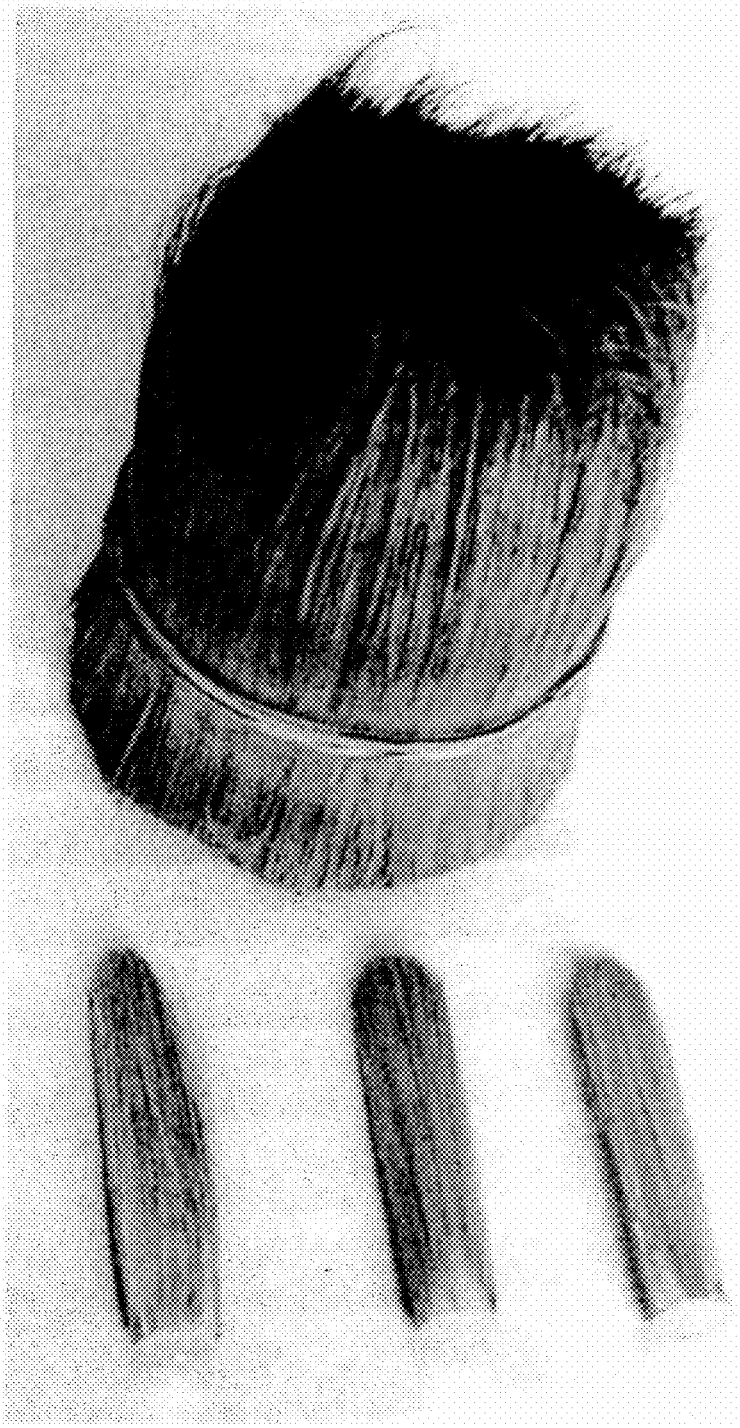
FIG. 3 represents an example of a bristle head obtained by the manufacturing method according to the present invention and a unit fiber bundle applied with a conductive treatment according to a conventional method.

The bristle head for a brush obtained by the above-described manufacturing method according to the present invention was evenly dyed throughout the entire head (in other words, a conductive portion was formed evenly), and no disarrangement and damage were exhibited at the fiber included in the bristle head. On the other hand, the unit fiber bundle applied with conductive treatment of a conventional method lacked uniformity in dye (in other words, having a portion with the conductive portion not evenly formed), and there was a disarrangement in the fiber, mainly on the outer side of the fiber bundle. FIG. 3 represents an example of the bristle head obtained by the manufacturing method according to the present invention and an example of the unit fiber bundle applied with the conductive treatment according to the conventional method. In the lower part of FIG. 3, three bristle heads obtained by the manufacturing method according to the present invention are presented. In the upper part of FIG. 3, one unit fiber bundle applied with the conductive treatment of the conventional method is presented.

As described above, the fiber bundle obtained by the conventional method requires selection of each fiber to form a bristle head, causing a large amount of waste. On the other hand, according to the bristle head obtained by the manufacturing method of the present invention has a high quality as described above. Therefore, there is not need of selection, and the step of selection can be omitted. Further, it became apparent that no waste of raw material occurs.

Further, the operation of selecting fibers having disarrangement and lack of uniformity in treatment causes a difficulty in screening by means of an automatic machine. Therefore, a manual operation was the only way to achieve the selecting operation. According to the manufacturing method of the present invention, the step of selection requiring work force can be omitted. Therefore, the entire manufacturing process can be automated, thus is suitable for a mass production.

The embodiments and the examples disclosed herein are illustrative and nom restrictive in every respect. The scope of the present invention is defined by the terms of the claims rather than the description above, and it is intended to include any modification within the scope and meaning equivalent to the terms of the claims.

Industrial Applicability

The manufacturing method according to the present invention is not limited for use in the method for manufacturing a bristle head for a brush involving the conductive treatment. It can be used in a method for manufacturing a bristle head for a brush involving the step of immersing fibers in various treatment liquids, such as the operation of dyeing and bleaching.

The invention claimed is:

1. A method for manufacturing a bristle head for a brush, comprising, a first step of obtaining a fiber bundle by reeling up a melt-spun synthetic fiber;

a second step of obtaining a unit fiber bundle by cutting said fiber bundle in a direction perpendicular to a longitudinal direction;

a third step of forming a tapered shape at a tip portion of each fiber included in said unit fiber bundle;

a fourth step of forming a bristle head by isolating a part of said unit fiber bundle; and a fifth step of forming a conductive portion including a conductive material on a surface of each fiber by immersing said bristle head in a treatment bath accommodating a treatment liquid, wherein said treatment liquid is an aqueous solution containing at least one type of metal ion selected from the group consisting of $Cu^{2+}$, $Ag^{+}$, and $Pd^{2+}$, and a reductant agent, or is a plating solution containing at least one type of metal selected from the group consisting of Cu, Ag, and Ni.

2. The method for manufacturing a bristle head for a brush according to claim 1, wherein said fiber has a fiber diameter greater than or equal to 0.05 mm and less than or equal to 1.00mm, and said bristle head has a diameter greater than or equal to 1.0 mm and less than or equal to 30.0mm.

3. The method for manufacturing a bristle head for a brush,. according to claim 1, wherein said synthetic fiber includes polybutylene terephthalate.

4. The method for manufacturing a bristle head for a brush,. according to claim 1, wherein said conductive material includes a sulfide of at least one type of metal selected from the group consisting of Cu, Ag, and Pd, or plating metal of at least one type of metal selected from the group consisting of Cu, Ag, and Ni.

5. The method for manufacturing a bristle head for a brush, according to claim 1, wherein said conductive material includes copper sulfide.

* * * * *